US011236583B2

(12) United States Patent
Chambers et al.

(10) Patent No.: US 11,236,583 B2
(45) Date of Patent: Feb. 1, 2022

(54) STEERING SYSTEM FOR USE WITH A DRILL STRING

(71) Applicant: Halliburton Energy Services, Inc., Houston, TX (US)

(72) Inventors: Larry DeLynn Chambers, Kingwood, TX (US); Neelesh V. Deolalikar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/758,117

(22) PCT Filed: Feb. 2, 2018

(86) PCT No.: PCT/US2018/016744

§ 371 (c)(1),
(2) Date: Apr. 22, 2020

(87) PCT Pub. No.: WO2019/133032

PCT Pub. Date: Jul. 4, 2019

(65) Prior Publication Data

US 2020/0308928 A1 Oct. 1, 2020

Related U.S. Application Data

(60) Provisional application No. 62/612,178, filed on Dec. 29, 2017.

(51) Int. Cl.
*E21B 34/06* (2006.01)
*E21B 7/06* (2006.01)

(52) U.S. Cl.
CPC ..... *E21B 34/06* (2013.01); *E21B 7/06* (2013.01)

(58) Field of Classification Search
CPC ..... E21B 34/06; E21B 7/06; E21B 7/068
See application file for complete search history.

(56) References Cited

U.S. PATENT DOCUMENTS 1,971,480 A * 8/1934 Earley ..... E21B 7/10 175/61
5,139,094 A * 8/1992 Prevedel ..... E21B 7/068 175/61

(Continued)

FOREIGN PATENT DOCUMENTS

EP 1247787 10/2012

OTHER PUBLICATIONS

ISRWO International Search Report and Written Opinion for PCT/US2018/016744 dated Sep. 10, 2018.

*Primary Examiner* — George S Gray
(74) *Attorney, Agent, or Firm* — Benjamin Ford; C. Tumey Law Group PLLC

(57) ABSTRACT

A drill string steering system includes a motor and a rotary valve body disposed in a tool body. The motor includes a motor shaft coupled to the motor and extending within a central bore of the tool body. The motor shaft has a downhole engagement portion that includes a first splined surface. The rotary valve body includes a disk-shaped component and a valve shaft coupled to the disk-shaped component and extending uphole of the disk-shaped component. The valve shaft includes a second splined surface engageable with the first splined surface for rotation of the motor shaft to be imparted to the rotary valve body.

20 Claims, 7 Drawing Sheets

(56) References Cited

U.S. PATENT DOCUMENTS

| | | | | |
|---|---|---|---|---|
| 5,520,255 | A * | 5/1996 | Barr | E21B 4/003 175/24 |
| 2002/0139584 | A1* | 10/2002 | Hughes | B23B 27/145 175/107 |
| 2008/0000693 | A1 | 1/2008 | Hutton | |
| 2010/0025116 | A1* | 2/2010 | Hutton | E21B 7/06 175/61 |
| 2014/0014413 | A1* | 1/2014 | Niina | E21B 21/10 175/61 |
| 2014/0124693 | A1 | 5/2014 | Gopalan et al. | |
| 2014/0262530 | A1* | 9/2014 | Petrovic | E21B 4/02 175/107 |
| 2015/0376948 | A1 | 12/2015 | Snyder et al. | |
| 2017/0292363 | A1* | 10/2017 | Deolalikar | E21B 44/005 |

* cited by examiner

STEERING SYSTEM FOR USE WITH A DRILL STRING

TECHNICAL FIELD

The present description relates in general to downhole tools, and more particularly, for example and without limitation, to steering systems for use with a drill string and methods of use thereof.

BACKGROUND OF THE DISCLOSURE

In the oil and gas industry, wellbores are commonly drilled to recover hydrocarbons such as oil and gas.

To reach desired subterranean formations, it is often required to undertake directional drilling, which entails dynamically controlling the direction of drilling, rather than simply drilling a nominally vertical wellbore path. Directionally drilled wellbores can include portions that are vertical, curved, horizontal, and portions that generally extend laterally at any angle from the vertical wellbore portions.

BRIEF DESCRIPTION OF THE DRAWINGS

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure.

DETAILED DESCRIPTION

Figure 1:
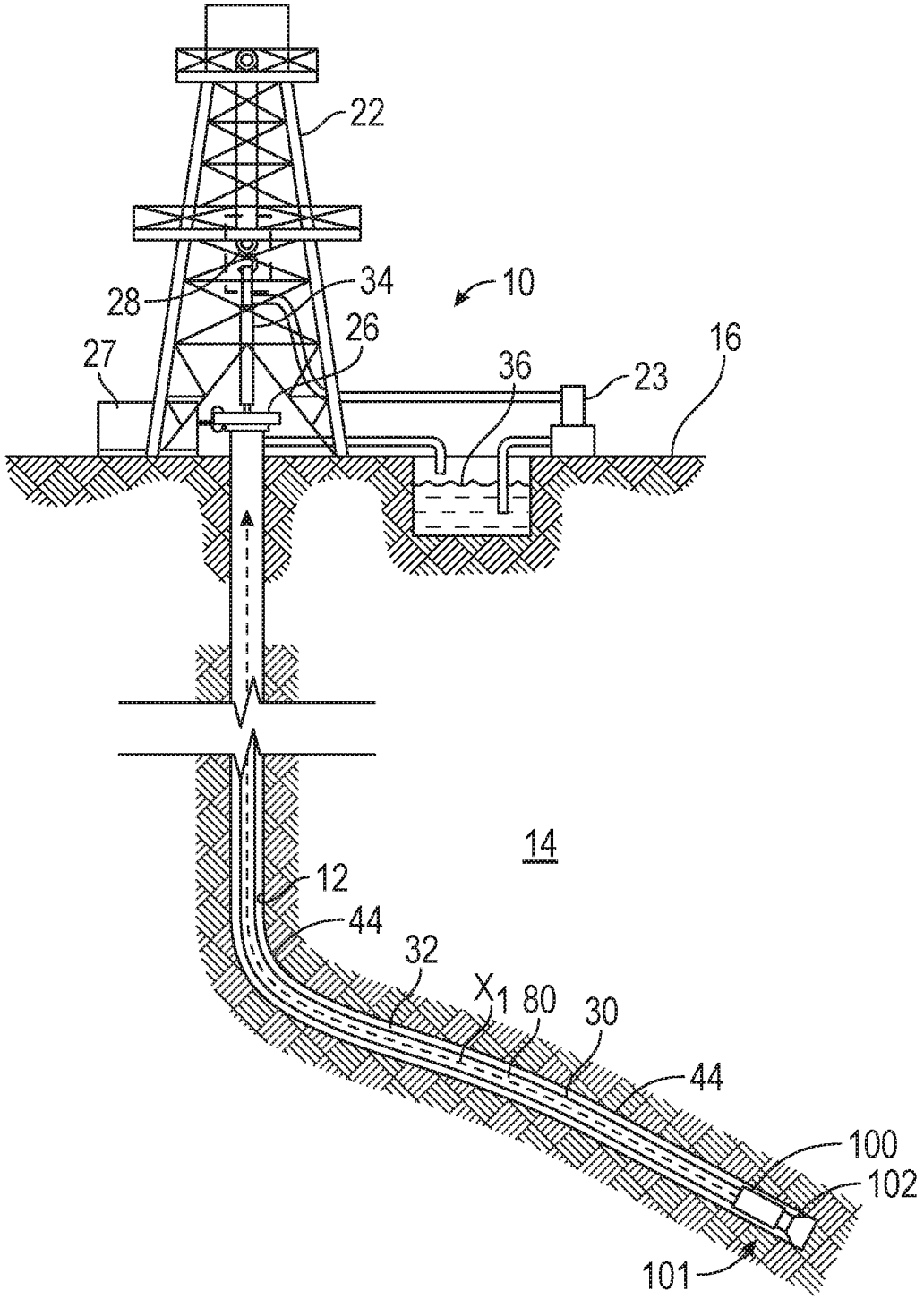
FIG. 1 illustrates a partial cross-sectional view of an onshore well system including a downhole tool illustrated as part of a tubing string, according to some embodiments of the present disclosure.

This section provides various example implementations of the subject matter disclosed, which are not exhaustive. As those skilled in the art would realize, the described implementations may be modified without departing from the scope of the present disclosure. Accordingly, the drawings and description are to be regarded as illustrative in nature and not restrictive.

The present description relates in general to downhole tools, and more particularly, for example and without limitation, to steering systems for use with a drill string and methods of use thereof.

A directional drilling technique can involve the use of a rotary steerable drilling system that controls an azimuthal direction and/or degree of deflection while the entire drill string is rotated continuously. Rotary steerable drilling systems typically involve the use of an actuation mechanism that helps the drill bit deviate from the current path using either a "point the bit" or "push the bit" mechanism. In a "point the bit" system, the actuation mechanism deflects and orients the drill bit to a desired position by bending the drill bit drive shaft within the body of the rotary steerable assembly. As a result, the drill bit tilts and deviates with respect to the wellbore axis. In a "push the bit" system, the actuation mechanism is used to instead push against the wall of the wellbore, thereby offsetting the drill bit with respect to the wellbore axis. While drilling a straight section, the actuation mechanism remains disengaged, so that there is generally no pushing against the formation, or optionally uniformly engaged, so there is no appreciable offset of the drill bit with respect to the wellbore axis. As a result, the drill string proceeds generally concentric to the wellbore axis. Yet another directional drilling technique, generally referred to as the "push to point," encompasses a combination of the "point the bit" and "push the bit" methods. Rotary steerable systems may utilize a plurality of steering pads that can be actuated in a lateral direction to control the direction of drilling, and the steering pads may be controlled by a variety of valves and control systems.

An aspect of at least some embodiments disclosed herein is that by allowing a valve body to move relative to a motor shaft, a valve body can more consistently be sealed against a flow manifold, which can improve the sealing performance of the steering system. A further aspect, according to at least some embodiments disclosed herein is that by allowing a valve body to move relative to a motor shaft, damage to the valve body and/or the flow manifold, such as to sealing faces thereof, can be mitigated. Yet another aspect, according to at least some embodiments disclosed herein, is that the use of a polycrystalline diamond compact sealing surface can reduce the sliding friction between the valve body and the flow manifold within the steering system. Yet another aspect, according to at least some embodiments disclosed herein, is that the use of a brazed valve seat on the flow manifold can improve the durability of the steering system.

Figure 2:
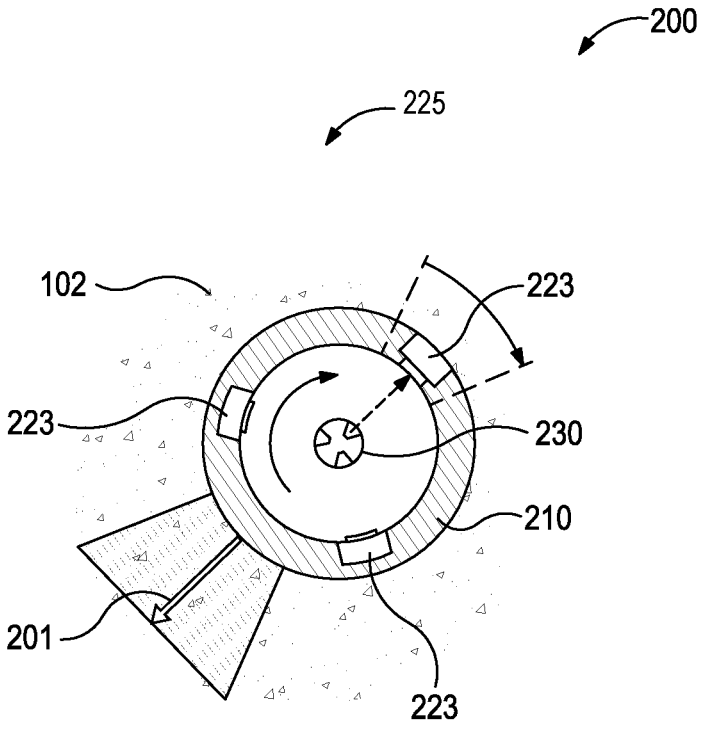
FIG. 2 is a cross-sectional view of a drill string steering system, according to some embodiments of the present disclosure.

FIG. 1 shows a representative elevation view in partial cross-section of an onshore well system 10 which can include a drilling rig (or derrick) 22 at the surface 16 used to extend a tubing string 30 into and through portions of a subterranean earthen formation 14. The tubing string 30 can carry a drill bit 102 at its end which can be rotated to drill through the formation 14. A bottom hole assembly (BHA) 101 interconnected in the tubing string 30 proximate the drill bit 102 can include components and assemblies (not expressly illustrated in FIG. 1), such as, but not limited to, logging while drilling (LWD) equipment, measure while drilling (MWD) equipment, a bent sub or housing, a mud motor, a near bit reamer, stabilizers, steering assemblies, and other downhole instruments. The BHA 101 can also include a downhole tool 100 that can provide steering to the drill bit 102, mud-pulse telemetry to support MWD/LWD activities, stabilizer actuation through fluid flow control, and a rotary steerable tool used for steering the wellbore 12 drilling of the drill bit 102. Steering of the drill bit 102 can be used to facilitate deviations 44 as shown in FIGS. 1 and 2, and/or steering can be used to maintain a section in a wellbore 12 without deviations, since steering control can also be needed to prevent deviations in the wellbore 12.

At the surface location 16, the drilling rig 22 can be provided to facilitate drilling the wellbore 12. The drilling rig 22 can include a turntable 26 that rotates the tubing string 30 and the drill bit 102 together about the longitudinal axis X1. The turntable 26 can be selectively driven by an engine 27, and selectively locked to prohibit rotation of the tubing string 30. A hoisting device 28 and swivel 34 can be used to manipulate the tubing string 30 into and out of the wellbore 12. To rotate the drill bit 102 with the tubing string 30, the turntable 26 can rotate the tubing string 30, and mud can be circulated downhole by mud pump 23. The mud may be a calcium chloride brine mud, for example, which can be pumped through the tubing string 30 and passed through the downhole tool 100. In some embodiments, the downhole tool 100 can include a pad pusher, and a rotary valve that selectively applies pressure to at least one output flow path to hydraulically actuate the pad pusher. Additionally, the mud can be pumped through a mud motor (not expressly illustrated in FIG. 1) in the BHA 101 to turn the drill bit 102 without having to rotate the tubing string 30 via the turntable 26.

Although the downhole tool 100 is shown and described with respect to a rotary drill system in FIG. 1, those skilled in the art will readily appreciate that many types of drilling systems can be employed in carrying out embodiments of the disclosure. For example, drills and drill rigs used in embodiments of the disclosure may be used onshore (as depicted in FIG. 1) or offshore (not shown). Offshore oilrigs that may be used in accordance with embodiments of the disclosure include, for example, floaters, fixed platforms, gravity-based structures, drill ships, semi-submersible platforms, jack-up drilling rigs, tension-leg platforms, and the like. It will be appreciated that embodiments of the disclosure can be applied to rigs ranging anywhere from small in size and portable, to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like. Further, embodiments of the disclosure may be used in weight-on-packers assemblies, in running liner hangers, in running completion strings, etc., without departing from the scope of the disclosure.

While not specifically illustrated, those skilled in the art will readily appreciate that the BHA 101 may further include various other types of drilling tools or components such as, but not limited to, a steering unit, one or more stabilizers, one or more mechanics and dynamics tools, one or more drill collars, one or more accelerometers, one or more magnetometers, and one or more jars, and one or more heavy weight drill pipe segments.

Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as wellbore construction for river crossing tunneling and other such tunneling wellbores for near surface construction purposes or wellbore u-tube pipelines used for the transportation of fluids such as hydrocarbons.

FIG. 2 is a cross-sectional view of a drill string steering system, according to some embodiments of the present disclosure. In the depicted example, the drill string steering system 200 utilizes a steering head 225 including one or more pad pushers 223 extending from the tool body 210 to push against the earth 102 to provide a drilling vector 201. As described herein, the combination of the steering pad 220 and the piston 224, whether being formed as separate parts that are coupled together, or being formed as a part of a single, continuous body, shall be referred to as a pad pusher 223. The pad pusher 223 may be actuated by the mud flow provided through the piston flow channel 242. In the depicted example, the drill string steering system 200 utilizes one or more pad pushers 223 extending from the tool body 210 to push against the earth 102 to provide a drilling vector 201. In the depicted example, the force of each pad pusher 223 of the drill string steering system 200 can be combined to provide the desired drilling vector 201. Further, in some embodiments, the timing and the duration of force of each pad pusher 223 can be controlled to control the desired drilling vector 201. In some embodiments, the drill string steering system 200 includes three pad pushers 223.

In the depicted example, the valve body 230 can be controlled to direct drilling fluid flow to selectively urge the pad pusher 223 with a desired force, timing, and/or duration, thereby steering the drill string and drill bit in the desired drilling vector 201.

Figure 3:
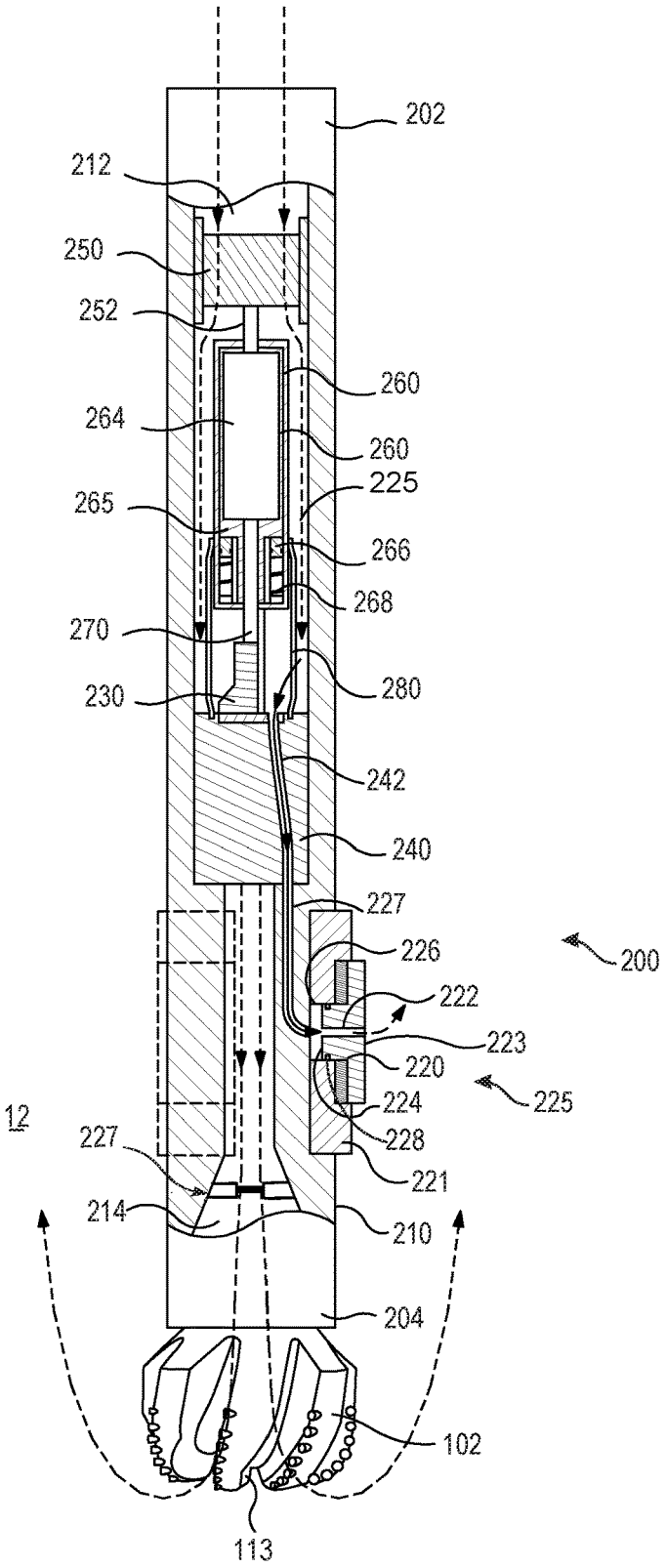
FIG. 3 illustrates a cross-sectional view of an exemplary drill string system of the downhole tool of FIG. 1, according to some embodiments of the present disclosure.

FIG. 3 illustrates a cross-sectional view of an exemplary drill string system of the downhole tool of FIG. 1, according to some embodiments of the present disclosure. In the depicted example, mud flows into the drill string steering system 200 from the uphole end 202 and passes through the central bore 212 to a valve body 230 and a flow manifold 240 to control the extension and retraction of the pad pushers 223.

As the mud flows through the central bore 212, the mud can flow through a turbine 250 and past a motor assembly 260 to the valve body 230 and the flow manifold 240. In the depicted example, mud flow can pass through a filter screen 280 prior to passing through the valve body 230 and the flow manifold 240. The filter screen 280 can include apertures or openings sized to allow the flow of mud while preventing debris from passing through the flow manifold 240 and to components downstream of the flow manifold 240 to prevent obstruction and damage to the downstream components. The filter screen 280 can be formed from a mesh or any other suitable filter material.

In the depicted example, the valve body 230 and the flow manifold 240 control the flow of the mud there through to control the extension of the pad pushers 223 of the steering head 225. In some embodiments, the rotation of the valve body 230 abutted against the flow manifold 240 controls the flow of mud through the flow manifold 240. The valve body 230 is rotated by a motor 264 coupled together by a valve drive mechanism 290.

In the depicted example, as mud flow is permitted by the valve body 230, the mud flow can continue in a piston flow channel 242 of the flow manifold 240. In some embodiments, a piston flow channel 242 can pass through the flow manifold 240 and the tool body 210 to provide mud flow to a piston bore 226. In the depicted example, the tool body 210 can include one or more piston bores 226 formed in the tool body 210. In some embodiments, the piston bores 226 are disposed within pad retention housings 221 formed within the tool body 210. In the depicted example, mud flow from the piston flow channel 242 is received by the piston bore 226 and the piston seals 228 to actuate and extend the piston 224 of the pad pusher 223. In some embodiments, a steering pad 220 can be integrally formed or otherwise coupled to the piston 224 as a pad pusher 223 to extend the steering pad 220 in response to the mud flow provided through the piston flow channel 242.

Pressure against the pad pusher 223 can be relieved by a relief flow channel 222 formed through the pad pusher 223. Mud flow can pass through the relief channel 222 to allow for maintaining or reducing pressure upon the piston 224 to facilitate the retraction of the piston 224.

In some embodiments, the mud flow can bypass the filter screen 280 and the flow manifold 240 to continue through the central bore 212 as a bypass flow 214. The bypass flow 214 can continue through the downhole end 204 of the drill string steering system 200 and can be directed to the bit nozzles 113 of the drill bit 102 to be circulated into an annulus of the wellbore 12.

In the depicted example, the valve body 230 is rotated by a motor 264 by a valve drive mechanism 290 that couples the motor shaft 270 to the valve body 230. In some embodiments, the motor 264 is an electrical motor that can be controlled to provide a desired drilling vector by rotating the valve body 230. In the depicted example, the motor 264 is part of a motor assembly 260 that is contained within a motor housing 262. In some embodiments, the motor 264 maintains the valve body 230 in a geostationary position as needed.

In the depicted example, components of the motor assembly 260 can be disposed, surrounded, bathed, lubricated, or otherwise exposed to a lubricant 265 within the motor housing 262. In some embodiments, the lubricant 265 is oil that is isolated from the mud within the wellbore 12. In the depicted example, the pressure of the lubricant 265 can be balanced with the downhole pressure of the mud. In some embodiments, a compensation piston 266 can pressurize the lubricant 265 to the same pressure as the surrounding mud without allowing fluid communication or mixing of the mud and the lubricant 265. In some embodiments, a biasing spring 268 can act upon the compensation piston 266 to provide additional pressure to the lubricant 265 within the motor housing 262 relative to the pressure of the mud. In some embodiments, the biasing spring 268 can impart around 25 psi of additional pressure to the lubricant 265 within the motor housing 262.

In the depicted example, electrical energy for the motor 264 is generated by mud flow passing through the turbine 250. In some embodiments, the turbine 250 can rotate about a turbine shaft 252 and power an electric generator.

Figure 4:
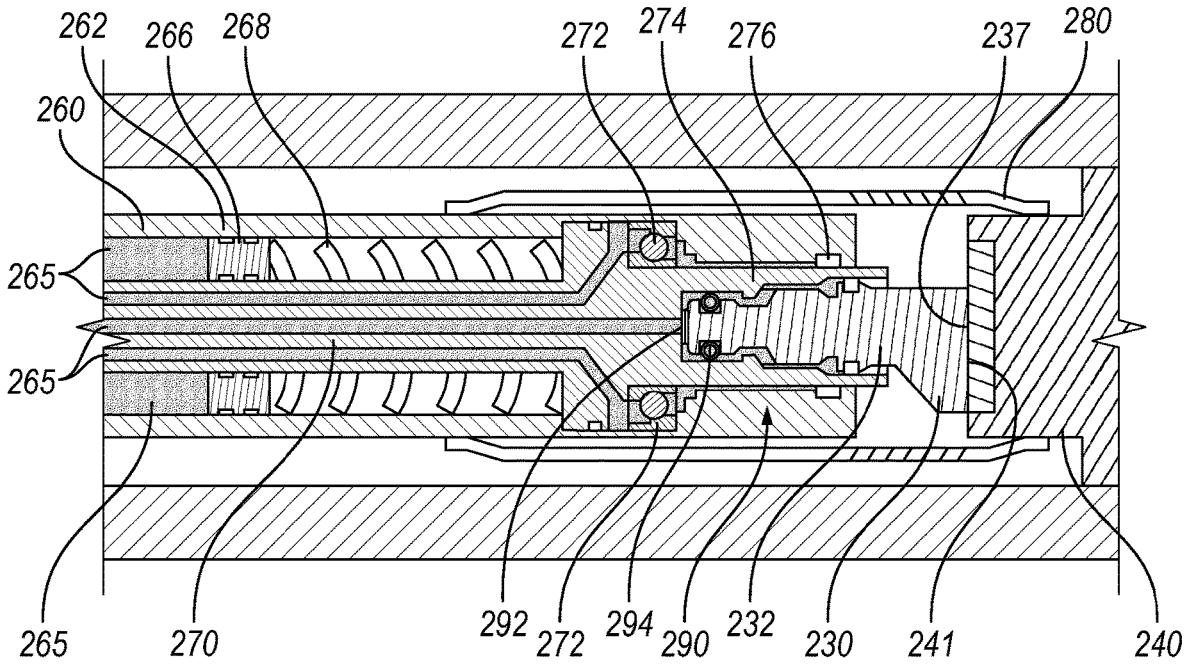
FIG. 4 is a sectional view of a valve drive mechanism of the drill string steering system of FIG. 3, according to some embodiments of the present disclosure.

FIG. 4 is a sectional view of a valve drive mechanism of the drill string steering system of FIG. 3, according to some embodiments of the present disclosure. In the depicted example, the valve drive mechanism 290 is rotated by the motor shaft 270. Portions of the valve drive mechanism 290 can be integrated with the motor shaft 270 to be formed as a single part from a continuous material. In the depicted example, the motor shaft 270 extends through the motor housing 262 to transmit torque from the motor to the valve drive mechanism 290. In the depicted example, the motor shaft 270 can rotate within the lubricant 265 disposed within the motor housing 262. In some embodiments, a rotary seal 276 disposed on the outer surface of the motor shaft 270 at or near the downhole end of the motor shaft 270 seals against the motor housing 262. In some embodiments, the rotary seal 276 can maintain lubricant 265 pressure within the motor housing 262 while preventing the intrusion of contaminants such as mud.

In some embodiments, the motor shaft 270 is supported within the motor housing 262 by a shaft bearing 272. The shaft bearing 272 can radially support or constrain the motor shaft 270 to prevent radial deflection or run-out, which can prevent damage to the rotary seal 276 while allowing for rotation of the motor shaft 270. In some embodiments, the shaft bearing 272 can axially support or constrain the motor shaft 270 to prevent thrust or axial movement of the motor shaft 270 relative to the motor housing 262.

In the depicted example, the valve drive mechanism 290 can transfer rotation from the motor shaft 270 to the rotary valve 230 while allowing axial and/or pivotal movement of the rotary valve 230 relative to the motor shaft 270. In the depicted example, the valve body 230 can be engaged with a downhole engagement portion 274 of the motor shaft 270. In some embodiments, a portion of the rotary valve 230, such as a valve shaft 232, is disposed within the downhole engagement portion 274. In the depicted example, the downhole engagement portion 274 can transmit rotational torque to the valve body 230. In some embodiments, a retention spring 294 can limit the axial travel of the valve body 230 relative to the motor shaft 270.

Advantageously, by allowing axial and pivotal movement of the rotary valve 230 relative to the motor shaft 270, the rotary valve 230 can avoid damage and maintain sealing abutment with the flow manifold 240 during deflection or other deformation of the drill string steering system 200. Further, axial and pivotal movement of the rotary valve 230 relative to the motor shaft 270 can reduce vibration and wear of the valve drive mechanism 290 during operation.

In the depicted example, a downhole sealing surface 237 of the valve body 230 can seal against the valve seat 241 to control flow through the flow manifold 240. In some embodiments, the sealing surface 237 can be formed from a polycrystalline diamond compact material. Similarly, in some embodiments, the valve seat 241 can be formed from a polycrystalline diamond compact material. In some embodiments, the polycrystalline diamond compact can have a cobalt backing. Advantageously, by forming the sealing surface 237 and the valve seat 241 from a polycrystalline diamond compact the interface therebetween can provide a low coefficient of sliding friction and a high rate of heat transfer during operation. In some embodiments, the interface between the sealing surface 237 and the valve seat 241 can be greased to reduce friction and heat.

In some embodiments, the sealing surface 237 can be preloaded against the valve seat 241 of the flow manifold 240 to facilitate sealing therebetween and prevent damage to the sealing surface 237 of the valve body 230 and the valve seat 241. A preload spring 292 within the valve drive mechanism 290 can provide a desired level of preload for the sealing surface 237 against the valve seat 241 by urging the valve body 230 axially opposed to the motor shaft 270. In some embodiments, the preload spring 292 can prevent damage to the sealing surface 237 during transport by engaging the valve seat 241.

In some embodiments, the sealing surface 237 can be loaded or stabilized against the valve seat 241 during operation to allow for sealing abutment there between and preventing excess wear or erosion of the sealing surface 237 and the valve seat 241. In some embodiments, an operational axial force can be imparted on the valve body 230 by the lubricant 265 within the motor housing 262. As previously described, the lubricant 265 can be pressurized by the compensation piston 266. In some embodiments, the biasing spring 268 can act upon the compensation piston 266 to further pressurize the lubricant 265 and provide additional stabilization force on the valve body 230 against the valve seat 241. In some embodiments, a differential pressure across the filter screen 280 works to restrain the valve body 230 on the valve seat 241.

Figure 5:
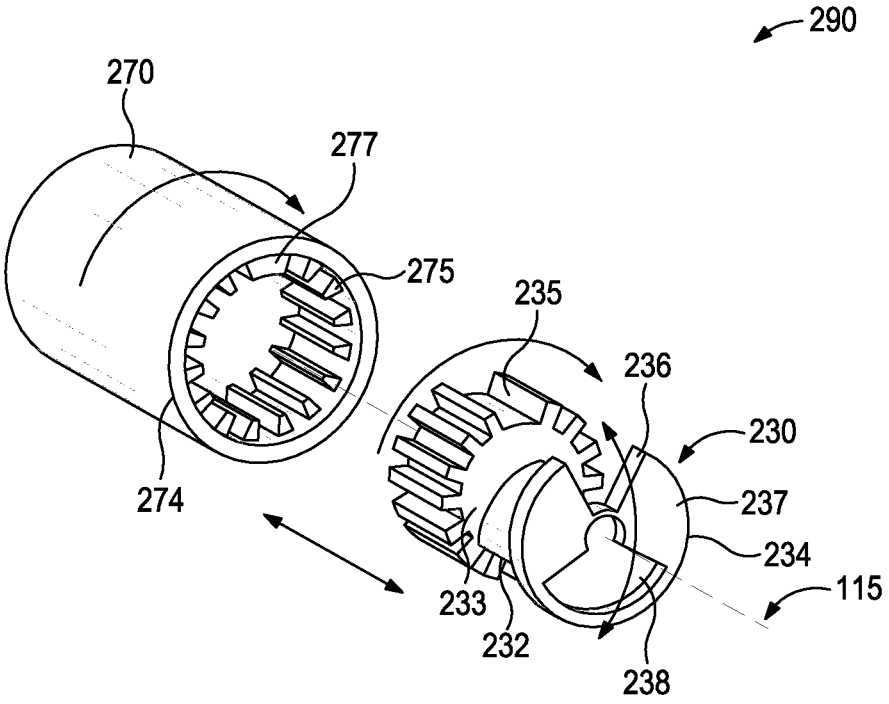
FIG. 5 is a perspective view of the valve drive mechanism of the drill string steering system of FIG. 3, according to some embodiments of the present disclosure.

FIG. 5 is a perspective view of the valve drive mechanism of the drill string steering system of FIG. 3, according to some embodiments of the present disclosure. In the depicted example, the valve drive mechanism 290 utilizes a splined interface between a splined surface 275 of the motor shaft 270 and a splined surface 233 of the valve body 230 to transfer rotation from the motor shaft 270 to the valve body 230. In some embodiments, the motor shaft 270 includes a splined surface 275 on the downhole engagement portion 274. In some embodiments, the splines of the splined surface 275 are equidistantly disposed about the downhole engagement portion 274. In some embodiments, the downhole engagement portion 274 is a female coupling with the splined surface 275 disposed on an inner surface of the downhole engagement portion 274.

In the depicted example, the valve shaft 232 of the valve body 230 includes a splined surface 233. In some embodiments, the splines of the splined surface 233 are equidistantly disposed about the valve shaft 232. In some embodiments, the valve shaft 232 is a male coupling with the splined surface 233 disposed on an outer surface of the valve shaft 232. In the depicted example, the splines of the splined surface 275 and the splined surface 233 can rotationally lock to transmit torque from the motor shaft 270 to the valve body 230.

In some embodiments, the splined surface 233 of the valve body 230 can move axially relative to the splined surface 275 of the motor shaft 270 along the rotational axis 115. In some embodiments, the valve drive mechanism 290 does not constrain the axial movement of the valve body 230 relative to the motor shaft 270. In some embodiments, the axial movement of the valve body 230 is limited by a retention spring. In some embodiments, axial movement of the valve body 230 relative to the motor shaft 270 is between about 0 millimeters to about 10 millimeters, about 0 millimeters to about 7 millimeters, about 0 millimeters to about 5 millimeters, or about 0 millimeters to about 3 millimeters.

In some embodiments, the valve body 230 can pivot relative to the motor shaft 270. In some embodiments, the splined surface 233 of the valve shaft 233 can be of a reduced diameter or be tapered relative to the splined surface 275 of the downhole engagement portion 274 to allow the valve body 230 to pivot relative to the motor shaft 270. The depth of the splines of the splined surface 233 and splined surface 275 can be configured to allow pivoting movement of the valve body 230 while allowing torque transfer therebetween. In some embodiments, the valve drive mechanism 290 allows the valve body 230 to pivot up to about 15 degrees relative to the rotational axis 115 without damaging the splined surface 233 and the splined surface 275. In some embodiments, the valve drive mechanism can allow the valve body to pivot up to about 4 degrees, up to about 6 degrees, up to about 8 degrees, up to about 10 degrees, or up to about 12 degrees, or about 1 degree, about 2 degrees, about 3 degrees, about 4 degrees, about 5 degrees, about 6 degrees, about 7 degrees, about 8 degrees, about 9 degrees, about 10 degrees, about 11 degrees, about 12 degrees, about 13 degrees, about 14 degrees, about 15 degrees, or more.

In some embodiments, to aid in assembly or repair, the valve drive mechanism 290 can include an alignment feature to allow for proper rotational indexing between the motor shaft 270 and the valve body 230. In the depicted example, the splined surface 275 of the downhole engagement portion 274 can include a keyed spline 277. The keyed spline 277 can be an enlarged spline or tooth, or an omitted spline to index the rotation of the motor shaft 270. The splined surface 233 on the valve shaft 232 can include a complimentary keyway 235 that receives the keyed spline 277 to index or clock the valve body 230 relative to the motor shaft 270.

In the depicted example, the rotation of the valve shaft 232 rotates the disk-shaped portion 234 of the valve body 230 to control flow through the flow manifold. The disk-shaped portion 234 includes an actuation flow channel 236 to allow flow to pass through a selected portion of the flow manifold and the downhole sealing surface 237 to prevent flow through a selected portion of the flow manifold.

Figure 6:
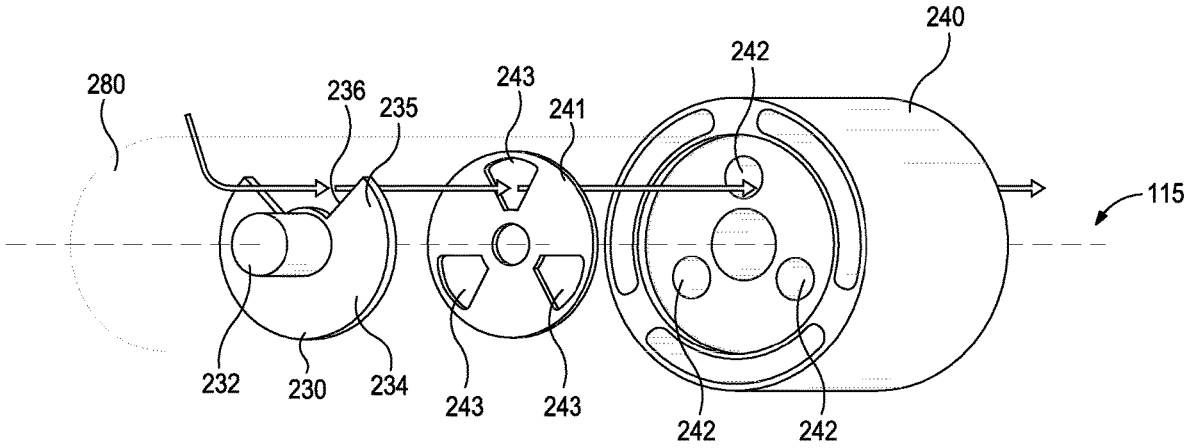
FIG. 6 is a perspective view of a rotary valve and a flow manifold of the drill string steering system of FIG. 3, according to some embodiments of the present disclosure.

In the depicted example, a backflow channel 238 can be formed in the sealing surface 237 to direct backflow from retracting pads to an exhaust channel of the flow manifold. The backflow channel 238 can be recessed portion of the sealing surface 237 to provide a flow path separate from the actuation flow channel 236. The backflow channel 238 can define a circular sector recess that is opposite, complimentary to, or spaced apart from the circular sector formed by the actuation flow channel 236, as shown in FIG. 6. The recessed shape of the backflow channel 238 can permit the downhole sealing surface 237 to be in contact with the valve seat 241 to form a seal thereagainst while permitting a degree of backflow from a piston flow channel 242 of the flow manifold 240, as discussed further below.

FIG. 6 is a perspective view of a rotary valve and a flow manifold of the drill string steering system of FIG. 3, according to some embodiments of the present disclosure. In the depicted example, mud flow through the flow manifold 240 can be controlled by the rotational position of the valve body 230 relative to the flow manifold 240. In the depicted example, the valve shaft 232 is shown without a splined surface.

In the depicted example, the flow manifold 240 can include a plurality of piston flow channels 242 extending through the flow manifold 240. In some embodiments, the flow manifold 240 includes three piston flow channels 242. The piston flow channels 242 can be circumferentially disposed at a desired radial distance from the rotational axis 115 of the flow manifold 240. In some embodiments, the piston flow channels 242 can have a circular cross-sectional profile.

In the depicted example, the valve body 230 can abut against the flow manifold 240 to selectively direct mud flow into the piston flow channels 242. In some embodiments, a valve seat 241 disposed on an uphole surface of the flow manifold 240 can seal against the downhole sealing surface 237 of the valve body 230. The valve seat 241 can include cut outs 243 corresponding to the cross-sectional shape of the piston flow channels 242. In some embodiments, the valve seat 241 can be brazed onto the flow manifold 240 to reduce erosion and to allow for different rates of thermal expansion of the valve seat 241 and the flow manifold 240. In some embodiments, the valve seat 241 can be de-brazed for maintenance.

In the depicted example, to control the flow to the piston flow channels 242, an actuation flow channel 236 of the valve body 230 can be aligned with a desired piston flow channel 242 to allow flow therethrough. By rotating the valve body 230 and therefore the actuation flow channel 236, flow to the corresponding pad pusher can be increased or decreased to control the actuation of the piston and the integrated steering pad. In some embodiments, the filter screen 280 can be disposed around the piston flow channels 242 to filter or remove debris from entering the piston flow channel 242 during actuation.

In the depicted example, the actuation flow channel 236 can be formed within a circular sector of the disk-shaped component 234. The actuation flow channel 236 can be formed within a circular sector of between about 30 degrees to about 120 degrees of the disk-shaped component 234, a circular sector of between about 45 degrees to about 90 degrees of the disk-shaped component 234, a circular sector of between about 60 degrees to about 75 degrees of the disk-shaped component 234, or a circular sector of between about 65 degrees to about 70 degrees of the disk-shaped component 234.

Figure 7:
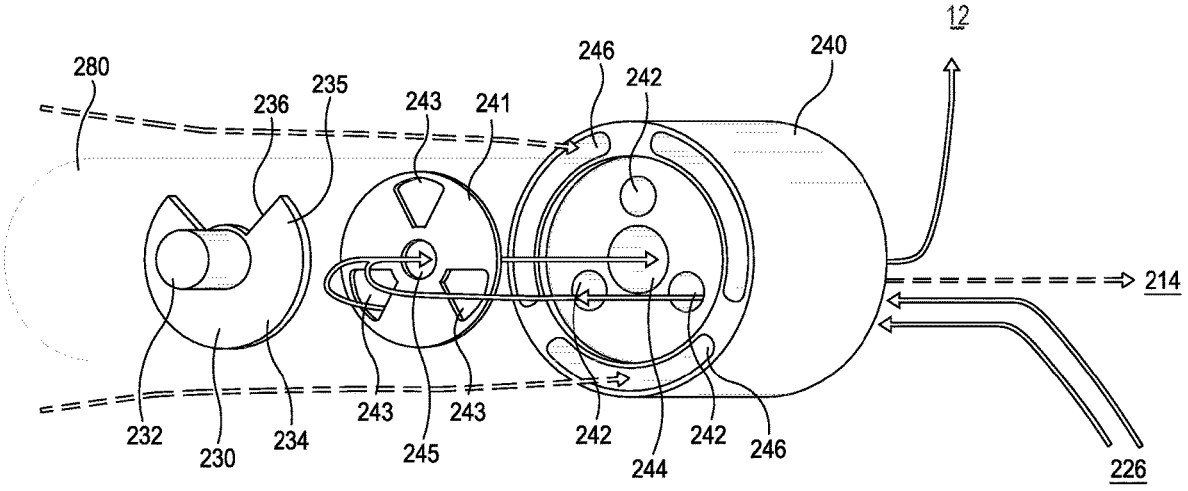
FIG. 7 is a perspective view of a rotary valve and a flow manifold of the drill string steering system of FIG. 3, according to some embodiments of the present disclosure.

FIG. 7 is a perspective view of a rotary valve and a flow manifold of the drill string steering system of FIG. 3, according to some embodiments of the present disclosure. During retraction of pad pushers, backflow from piston bores 226 to an exhaust channel 244 can be controlled by the rotational position of the valve body 230 relative to the flow manifold 240.

In the depicted example, the flow manifold 240 can include an exhaust channel 244 in fluid communication with an annulus of the wellbore 12. The exhaust channel 244 can be centrally disposed within the flow manifold 240. In some embodiments, the exhaust channel 244 has a central axis that is coaxial with the rotational axis 115 of the flow manifold 240. The piston flow channels 242 can be circumferentially disposed around and radially spaced apart from the exhaust channel 244. The exhaust channel 244 can have a circular cross-sectional profile. In some embodiments, the valve seat 241 includes a central cut out 245 corresponding to the exhaust channel 244.

In some embodiments, the valve body 230 rotates about the central axis of the exhaust channel 244. In the depicted example, to control backflow from the piston bores 226 and the piston flow channels 242 to the exhaust channel 244, the disk-shaped component 234 of the valve body 230 can be aligned to link the desired piston flow channels 242 with the exhaust channel 244 in fluid communication. In some embodiments, the sector of the circular profile complimentary to the actuation flow channel 236 can determine the coverage of the disk-shaped component 234 relative to the piston flow channels 242. By rotating the valve body 230 and therefore the disk-shaped component 234, backflow to the exhaust channel 244 from one or more piston flow channels 242 can be increased or decreased to control the retraction of the pad pusher by controlling the flow out of the piston bore 266.

In the depicted example, the flow manifold 240 can include a plurality of bypass flow channels 246 to allow mud flow to pass through the flow manifold 240 to a bypass flow 214 without actuating a steering pad. The bypass flow channels 246 can circumferentially disposed at a desired radial distance from the rotational axis of the flow manifold 115. In some embodiments, the bypass flow channels 246 can be disposed at a radial distance greater than the radial distance of the piston flow channels 246 to allow the bypass flow channels 246 to circumscribe the piston flow channels 242. Similarly, the bypass flow channels 246 can circumscribe the valve seat 241. In some embodiments, the bypass flow channels 246 can have an oblong or ellipsoid cross-sectional profile. In some embodiments, flow through the bypass flow channels 246 can also bypass the filter screen 280, as the bypass flow channels 246 can circumscribe the filter screen 280.

Various examples of aspects of the disclosure are described below as clauses for convenience. These are provided as examples, and do not limit the subject technology.

Clause 1. A drill string steering system, the drill string steering system comprising: a tool body having a central bore; a motor disposed within the central bore; a motor shaft coupled to the motor and extending within the central bore of the tool body, the motor shaft having a downhole engagement portion that includes a first splined surface; and a rotary valve body including a disk-shaped component and a valve shaft coupled to the disk-shaped component and extending uphole of the disk-shaped component, the valve shaft including a second splined surface engageable with the first splined surface for rotation of the motor shaft to be imparted to the rotary valve body.

Clause 2. The drill string steering system of Clause 1, wherein the first splined surface is formed within a female coupling portion and the second splined surface is formed on a male coupling portion.

Clause 3. The drill string steering system of Clause 1, wherein the rotary valve body is axially movable relative to the motor shaft.

Clause 4. The drill string steering system of Clause 3, wherein an axial travel of the rotary valve body relative to the motor shaft is between about 0 millimeters to about 10 millimeters.

Clause 5. The drill string steering system of any preceding Clause, further comprising a retention spring disposed about the rotary valve body to limit an axial travel of the rotary valve body.

Clause 6. The drill string steering system of any preceding Clause, wherein the rotary valve body is pivotable relative to the motor shaft.

Clause 7. The drill string steering system of Clause 6, wherein a pivot angle of the rotary valve body relative to the motor shaft is up to 15 degrees.

Clause 8. The drill string steering system of Clause 6, wherein a pivot angle of the rotary valve body relative to the motor shaft is from about 1 degree to about 10 degrees.

Clause 9. The drill string steering system of Clause 6, wherein a pivot angle of the rotary valve body relative to the motor shaft is from about 2 degree to about 8 degrees.

Clause 10. The drill string steering system of any preceding Clause, wherein the first splined surface includes a plurality of shaft splines equidistantly disposed about the motor shaft.

Clause 11. The drill string steering system of Clause 10, wherein the plurality of shaft splines includes a keyway.

Clause 12. The drill string steering system of any preceding Clause, wherein a torque is transmitted from the motor shaft to the valve shaft.

Clause 13. The drill string steering system of any preceding Clause, further comprising a shaft bearing to laterally support the motor shaft, wherein the motor shaft is rotatable relative to the shaft bearing.

Clause 14. The drill string steering system of Clause 13, wherein the shaft bearing axially supports the motor shaft.

Clause 15. The drill string steering system of any preceding Clause, further comprising a lubricant disposed within the tool body, wherein the motor shaft is disposed within the lubricant.

Clause 16. The drill string steering system of Clause 15, further comprising a compensation piston in fluid communication with the lubricant.

Clause 17. The drill string steering system of Clause 16, further comprising a biasing spring coupled to the compensation piston to bias the compensation piston and pressurize the lubricant.

Clause 18. The drill string steering system of any preceding Clause, wherein disk-shaped component includes a sealing surface.

Clause 19. The drill string steering system of Clause 18, wherein the sealing surface comprises a polycrystalline diamond compact.

Clause 20. The drill string steering system of Clause 18, wherein the sealing surface comprises backflow channel.

Clause 21. The drill string steering system of any preceding Clause, wherein the rotary valve body comprises an actuation flow channel formed through the disk-shaped component.

Clause 22. The drill string steering system of any preceding Clause, further comprising a filter screen disposed around the rotary valve body.

Clause 23. A drill string steering system, the drill string steering system comprising: a flow manifold including a valve seat; a tool body having a central bore; a rotary valve body having a disk-shaped component that includes a sealing surface configured to be abutted against the valve seat; and a valve drive mechanism extending within the tool body central bore and coupled to the rotary valve body to rotate the rotary valve body, the valve drive mechanism including a splined joint for imparting rotation to the rotary valve body while permitting axial movement and pivoting movement of the rotary valve body relative to the tool body for maintaining abutment of the sealing surface against the valve seat.

Clause 24. The drill string steering system of Clause 23, wherein valve drive mechanism comprises a motor shaft and a valve shaft.

Clause 25. The drill string steering system of Clause 24, wherein the valve shaft is coupled to the rotary valve body.

Clause 26. The drill string steering system of Clause 24, wherein the rotary valve body is axially movable relative to the motor shaft.

Clause 27. The drill string steering system of Clause 26, wherein an axial travel of the rotary valve body relative to the motor shaft is between about 0 millimeters to about 10 millimeters.

Clause 28. The drill string steering system of Clause 24, further comprising a retention spring disposed about the rotary valve body to limit an axial travel of the rotary valve body.

Clause 29. The drill string steering system of Clause 24, wherein the rotary valve body is pivotable relative to the motor shaft.

Clause 30. The drill string steering system of Clause 29, wherein a pivot angle of the rotary valve body relative to the motor shaft is up to 15 degrees.

Clause 31. The drill string steering system of Clause 29, wherein a pivot angle of the rotary valve body relative to the motor shaft is from about 1 degree to about 10 degrees.

Clause 32. The drill string steering system of Clause 29, wherein a pivot angle of the rotary valve body relative to the motor shaft is from about 2 degree to about 8 degrees.

Clause 33. The drill string steering system of Clause 24, wherein a torque is transmitted from the motor shaft to the valve shaft.

Clause 34. The drill string steering system of Clause 24, further comprising a shaft bearing to laterally support the motor shaft, wherein the motor shaft is rotatable relative to the shaft bearing.

Clause 35. The drill string steering system of Clause 34, wherein the shaft bearing axially supports the motor shaft.

Clause 36. The drill string steering system of Clauses 23-35, wherein the valve seat is brazed on the flow manifold.

Clause 37. The drill string steering system of Clauses 23-36, wherein the valve seat comprises a polycrystalline diamond compact.

Clause 38. The drill string steering system of Clauses 23-37, further comprising a motor to rotate the rotary valve body.

Clause 39. The drill string steering system of Clauses 23-38, further comprising a lubricant disposed within the central bore of the tool body.

Clause 40. The drill string steering system of Clause 39, further comprising a compensation piston in fluid communication with the lubricant.

Clause 41. The drill string steering system of Clause 40, further comprising a biasing spring coupled to the compensation piston to bias the compensation piston and pressurize the lubricant.

Clause 42. The drill string steering system of Clauses 23-41, further comprising a filter screen disposed around the rotary valve body.

Clause 43. A method of steering a drill string, the method comprising: drilling into a subterranean formation with a drill bit operatively coupled to a drill string steering system, the drill string steering system including a rotary valve body rotatable with respect to a flow manifold and a valve drive mechanism to impart rotation to the rotary valve body, the rotary valve body including a sealing surface; rotating the rotary valve body via the valve drive mechanism with respect to the flow manifold; and moving the rotary valve body relative to a tool body for maintaining abutment of the sealing surface against the flow manifold.

Clause 44. The method of Clause 43, further comprising axially moving the rotary valve body relative to the tool body to align the sealing surface of the rotary valve body with the flow manifold.

Clause 45. The method of Clause 44, wherein an axial travel of the rotary valve body relative to the tool body is between about 0 millimeters to about 10 millimeters.

Clause 46. The method of Clause 45, further comprising limiting axial travel via a retention spring disposed about the rotary valve body.

Clause 47. The method of Clauses 43-46, further comprising pivotally moving the rotary valve body relative to the tool body to align the sealing surface of the rotary valve body with the flow manifold.

Clause 48. The method of Clause 47, wherein a pivot angle of the rotary valve body relative to the tool body is between 0 and 10 degrees.

Clause 49. The method of Clause 47, wherein a pivot angle of the rotary valve body relative to the flow manifold is up to 15 degrees.

Clause 50. The method of Clause 47, wherein a pivot angle of the rotary valve body relative to the flow manifold is from about 1 degree to about 10 degrees.

Clause 51. The method of Clause 47, wherein a pivot angle of the rotary valve body relative to the flow manifold is from about 2 degree to about 8 degrees.

Clause 52. The method of Clauses 43-51, further comprising filtering a flow into the flow manifold via a filter screen.

Clause 53. The method of Clauses 43-52, further comprising rotating the rotary valve body via a motor.

What is claimed is:

1. A drill string steering system, the drill string steering system comprising:

a tool body having a central bore;

a motor disposed within the central bore;

a motor shaft coupled to the motor and extending within the central bore of the tool body, the motor shaft having a downhole engagement portion that includes a first splined surface;

a rotary valve body including a disk-shaped component and a valve shaft coupled to the disk-shaped component and extending uphole of the disk-shaped component, the valve shaft including a second splined surface engageable with the first splined surface for rotation of the motor shaft to be imparted to the rotary valve body; and a preload spring disposed between the motor shaft and the rotary valve body, wherein the preload spring is configured to preload a sealing surface of the rotary valve body against a valve seat of a flow manifold via biasing the rotary valve body axially away from the motor shaft.

2. The drill string steering system of claim 1, wherein the first splined surface is formed within a female coupling portion and the second splined surface is formed on a male coupling portion.

3. The drill string steering system of claim 1, wherein the rotary valve body is axially movable relative to the motor shaft.

4. The drill string steering system of claim 1, further comprising a retention spring disposed about the rotary valve body to limit an axial travel of the motor shaft with respect to the rotary valve body.

5. The drill string steering system of claim 1, wherein the rotary valve body is pivotable relative to the motor shaft.

6. The drill string steering system of claim 1, wherein the first splined surface includes a plurality of shaft splines equidistantly disposed about the motor shaft.

7. The drill string steering system of claim 6, wherein the plurality of shaft splines includes a keyway.

8. The drill string steering system of claim 1, further comprising a lubricant disposed within the tool body, wherein the motor shaft is disposed within the lubricant.

9. The drill string steering system of claim 8, further comprising a compensation piston in fluid communication with the lubricant.

10. The drill string steering system of claim 9, further comprising a biasing spring coupled to the compensation piston to bias the compensation piston and pressurize the lubricant.

11. The drill string steering system of claim 1, wherein the disk-shaped component includes a sealing surface.

12. The drill string steering system of claim 11, wherein the sealing surface comprises a polycrystalline diamond compact.

13. The drill string steering system of claim 1, wherein the rotary valve body comprises an actuation flow channel formed through the disk-shaped component for actuating a downhole component of the drill string steering system.

14. A drill string steering system, the drill string steering system comprising:

a flow manifold including a valve seat;

a tool body having a central bore;

a rotary valve body having a disk-shaped component that includes a sealing surface configured to be abutted against the valve seat; and a valve drive mechanism extending within the tool body central bore and coupled to the rotary valve body to rotate the rotary valve body, the valve drive mechanism including a splined joint for imparting rotation to the rotary valve body while permitting axial movement and pivoting movement of the rotary valve body relative to the tool body for maintaining abutment of the sealing surface against the valve seat; and a preload spring disposed between a motor shaft of the valve drive mechanism and the rotary valve body, wherein the preload spring is configured to preload the sealing surface of the rotary valve body against the valve seat of the flow manifold via biasing the rotary valve body axially away from the motor shaft.

15. The drill string steering system of claim 14, wherein the valve seat is brazed on the flow manifold.

16. The drill string steering system of claim 14, wherein the valve seat comprises a polycrystalline diamond compact.

17. A method of steering a drill string, the method comprising:

drilling into a subterranean formation with a drill bit operatively coupled to a drill string steering system, the drill string steering system including a rotary valve body rotatable with respect to a flow manifold and a valve drive mechanism to impart rotation to the rotary valve body, the rotary valve body including a sealing surface;

rotating the rotary valve body via the valve drive mechanism with respect to the flow manifold;

preloading the sealing surface of the rotary valve body against a valve seat of the flow manifold via a preload spring disposed between a motor shaft of the valve drive mechanism and the rotary valve body, wherein the preload spring is configured to bias the rotary valve body axially away from the motor shaft; and moving the rotary valve body relative to a tool body for maintaining abutment of the sealing surface against the valve seat of the flow manifold.

18. The method of claim 17, further comprising axially moving the rotary valve body relative to the tool body to align the sealing surface of the rotary valve body with the flow manifold.

19. The method of claim 18, further comprising limiting axial travel of the motor shaft with respect to the rotary valve body via a retention spring disposed about the rotary valve body.

20. The method of claim 17, further comprising pivotally moving the rotary valve body relative to the tool body to align the sealing surface of the rotary valve body with the flow manifold.

* * * * *